US007823251B2

(12) United States Patent
Dyson et al.

(10) Patent No.: US 7,823,251 B2
(45) Date of Patent: Nov. 2, 2010

(54) SURFACE TREATING APPLIANCE

(75) Inventors: James Dyson, Gloucestershire (GB); Stephen Benjamin Courtney, Bath (GB); Peter David Gammack, Wiltshire (GB); William Robert James White, Wiltshire (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 0 days.

(21) Appl. No.: 11/794,981

(22) PCT Filed: Jan. 13, 2006

(86) PCT No.: PCT/GB2006/000115

§ 371 (c)(1),
(2), (4) Date: Jan. 28, 2008

(87) PCT Pub. No.: WO2006/077382

PCT Pub. Date: Jul. 27, 2006

(65) Prior Publication Data

US 2008/0115313 A1 May 22, 2008

(30) Foreign Application Priority Data

Jan. 18, 2005 (GB) ..... 0500992.3

(51) Int. Cl.
*A47L 9/00* (2006.01)
*A47L 5/28* (2006.01)

(52) U.S. Cl. ..... 15/336; 15/334; 15/411

(58) Field of Classification Search ..... 15/336, 15/363, 334, 350, 351
See application file for complete search history.

(56) References Cited

U.S. PATENT DOCUMENTS

| | | | | |
|---|---|---|---|---|
| 1,862,941 | A | 6/1932 | Replogle | |
| 1,884,865 | A | 10/1932 | Replogle | |
| 4,156,952 | A | 6/1979 | Lynch, Jr. | |
| 4,472,855 | A * | 9/1984 | Murphy et al. | 15/323 |
| 6,173,474 | B1 | 1/2001 | Conrad | |
| 2003/0101536 | A1 | 6/2003 | Hefter et al. | |

FOREIGN PATENT DOCUMENTS

| | | |
|---|---|---|
| EP | 0 351 294 | 1/1990 |
| EP | 1 121 889 A | 8/2001 |
| GB | 755 135 | 8/1956 |
| GB | 2 391 459 A | 2/2004 |
| JP | 11-178756 A | 7/1999 |

OTHER PUBLICATIONS

ISR directed to PCT/GB2006/000115.
GB Search Report directed to GB 0500992.3.

* cited by examiner

*Primary Examiner*—Dung Van Nguyen
(74) *Attorney, Agent, or Firm*—Morrison & Foerster LLP

(57) ABSTRACT

A surface-treating appliance in the form of a vacuum cleaner has a main body, a surface-treating head and a support assembly. The support assembly is moveable between a supporting position, in which it supports the main body, and a stored position, in which it lies substantially against the main body. The provision of a support assembly that lies substantially against the main body of the appliance when not needed improves the maneuverability and range of motion achievable by the appliance in use. The support assembly may be brought out of its supporting position by a user-depressible pedal, which makes the appliance user-friendly.

26 Claims, 9 Drawing Sheets

SURFACE TREATING APPLIANCE

REFERENCE TO RELATED APPLICATIONS

This application is a national stage application under 35 USC 371 of International Application No. PCT/GB2006/000115, filed Jan. 13, 2006, which claims the priority of United Kingdom Application No. 0500992.3, filed Jan. 18, 2005, the contents of both of which prior applications are incorporated herein by reference.

FIELD OF THE INVENTION

This invention relates to a surface treating appliance, such as a vacuum cleaner.

BACKGROUND OF THE INVENTION

Surface treating appliances such as vacuum cleaners and floor polishers are well known. The majority of vacuum cleaners are either of the 'upright' type or of the 'cylinder' type, called canister or barrel cleaners in some countries. A typical upright vacuum cleaner comprises a main body which houses the main components of the vacuum cleaner, such as a motor and fan for drawing dirty air into the machine and some form of separating apparatus for separating dirt, dust and other debris from a dirty airflow drawn in by the fan. The main body also houses filters for trapping fine particles in the cleaned airflow. A cleaner head is rotatably mounted to the lower end of the main body. A supporting wheel is mounted on each side of the lower part of the main body, in a fixed relationship to the main body. In use, a user reclines the main body of the vacuum cleaner and then pushes and pulls a handle which is fixed to the main body of the cleaner. The vacuum cleaner rolls along the floor surface on the supporting wheels.

A dirty-air inlet is located on the underside of the cleaner head. Dirty air is drawn into the dust separating apparatus via the dirty-air inlet by means of the motor-driven fan. When the dirt and dust entrained within the air has been separated from the airflow in the separating apparatus, air is conducted to the clean air outlet by a second air flow duct, and via one or more filters, and expelled into the atmosphere.

Conventional upright vacuum cleaners have a disadvantage in that they can be difficult to manoeuvre about an area in which they are used. They can be pushed and pulled easily enough, but pointing the cleaner in a new direction is more difficult. It has been proposed to make an upright vacuum cleaner more manoeuvrable by substituting a wide rolling support for the supporting wheels, such as is described in our patent application GB2391459. However, such an appliance requires further support when in the vertical position, which can prove cumbersome and unwieldy during use.

SUMMARY OF THE INVENTION

The invention provides a surface-treating appliance having a main body moveable between a substantially vertical position and a reclined position, a surface-treating head and a support assembly moveable between a supporting position, in which it supports the main body, and a stored position, in which it lies substantially against the main body, the appliance further comprising an actuating mechanism arranged to bring the support assembly into the stored position as the main body is reclined by a user.

The provision of a support assembly that lies substantially against the main body of the appliance when not needed improves the manoeuvrability and range of motion achievable by the appliance in use. The actuating mechanism brings the support assembly into the stored position as the main body is reclined by the user. This permits the support assembly to automatically retract when the user reclines the appliance for upright cleaning.

Preferably a pedal is provided, which is depressible by the user in order to release the appliance from the vertical position. This has the advantage of being intuitive to use.

The actuating mechanism may also be arranged to bring the support assembly back into the supporting position as the main body is returned to the vertical position by the user.

The actuating mechanism may be associated with a changeover mechanism arranged to allow fluid flow from the surface-treating head or from a hose located on the main body. The actuating mechanism may cause the changeover mechanism to allow fluid flow from the head when the main body is in the reclined position, and fluid flow from the hose when the main body is in the vertical position.

Resilient means may also be provided to positively put the support assembly into the supporting and stored positions.

The support assembly moves upwardly when moving from the supporting position to the stored position, this motion being activated by a counter-movement—namely, the user pushing the pedal downwardly.

The invention is particularly suitable for inclusion in upright vacuum cleaners having a wide, ball-like rolling support assembly, but may be applied to more conventional upright cleaners and other domestic appliances.

The term "surface treating appliance" is intended to have a broad meaning, and includes a wide range of machines having a head for travelling over a surface to clean or treat the surface in some manner. It includes, inter alia, machines which apply suction to the surface so as to draw material from it, such as vacuum cleaners (dry, wet and wet/dry), as well as machines which apply material to the surface, such as polishing/waxing machines, pressure washing machines, ground marking machines and shampooing machines. It also includes lawn mowers and other cutting machines.

BREIF DESCRIPTION OF THE DRAWINGS

The invention will now be described, by way of example, with reference to the accompanying drawings, in which.

Figure 1:
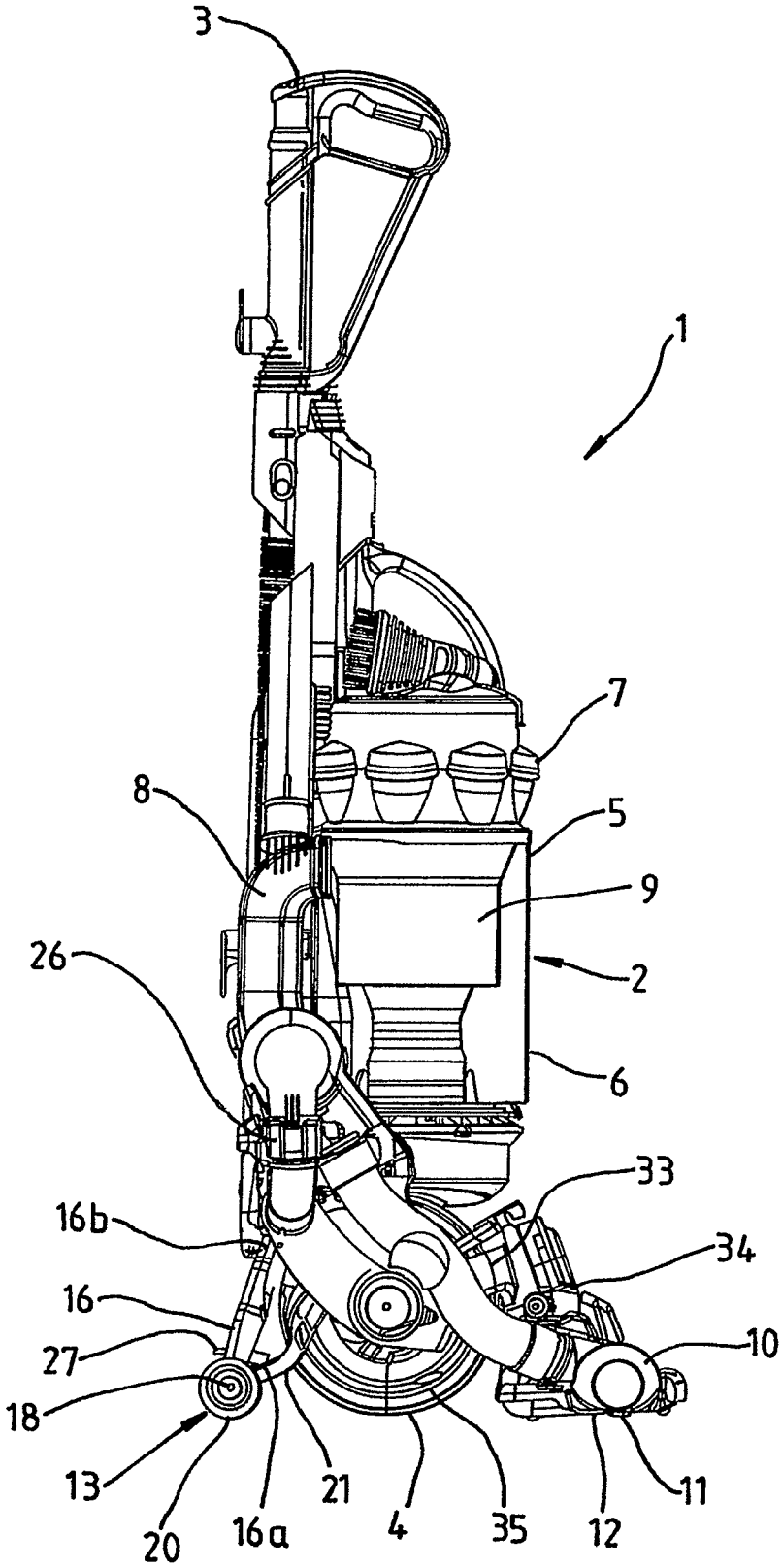
FIG. 1 is a side view of a surface-treating appliance constructed according to the invention.
Figure 2:
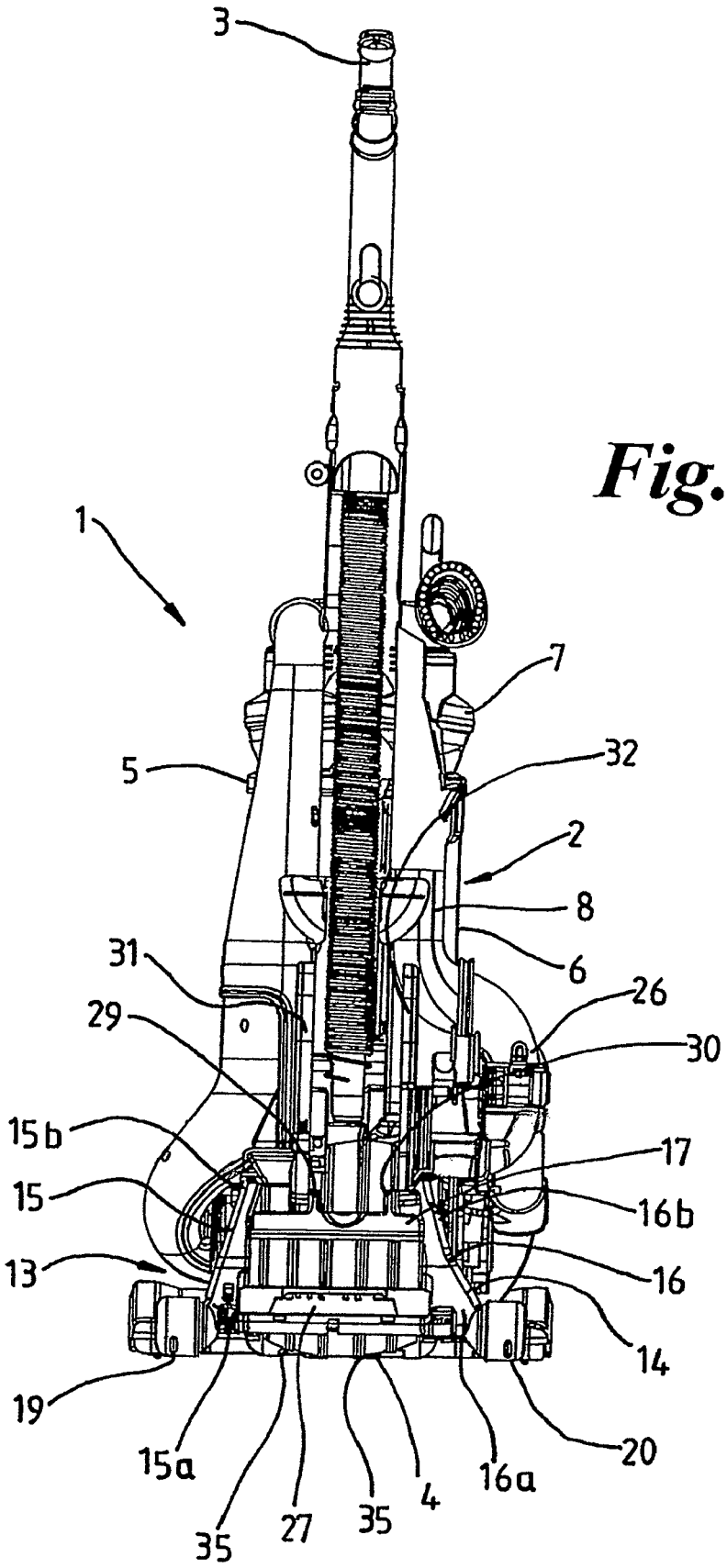
FIG. 2 is a rear view of the appliance of FIG. 1.
Figure 3A:
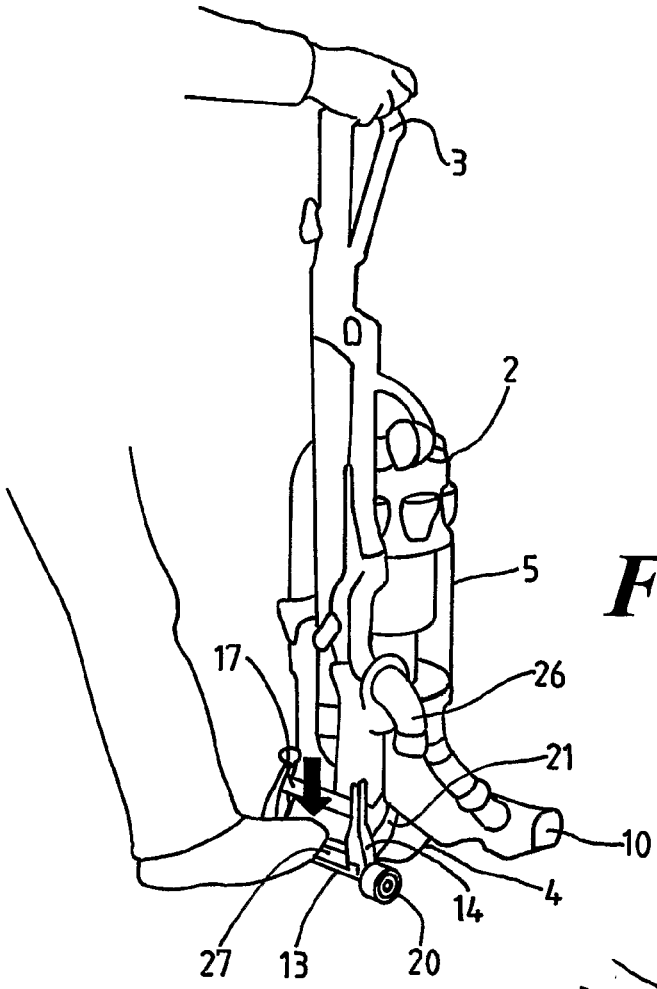
Figure 3B:
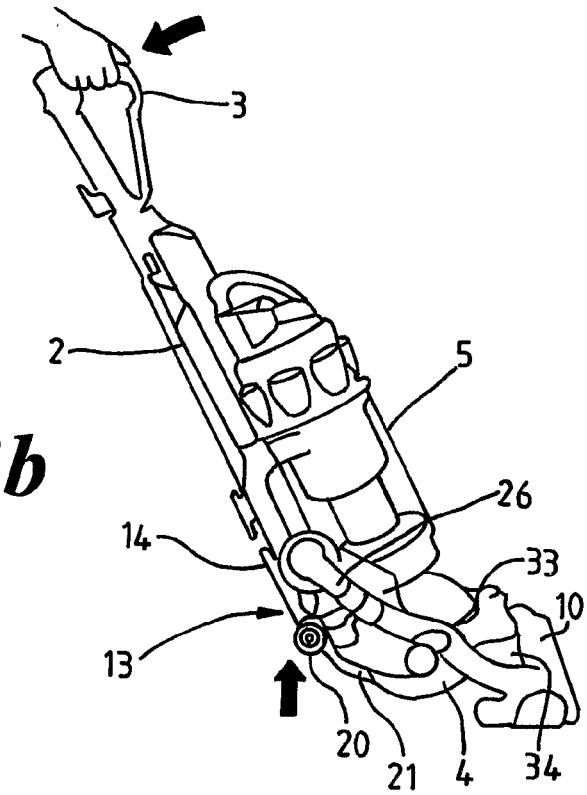
Figure 4A:
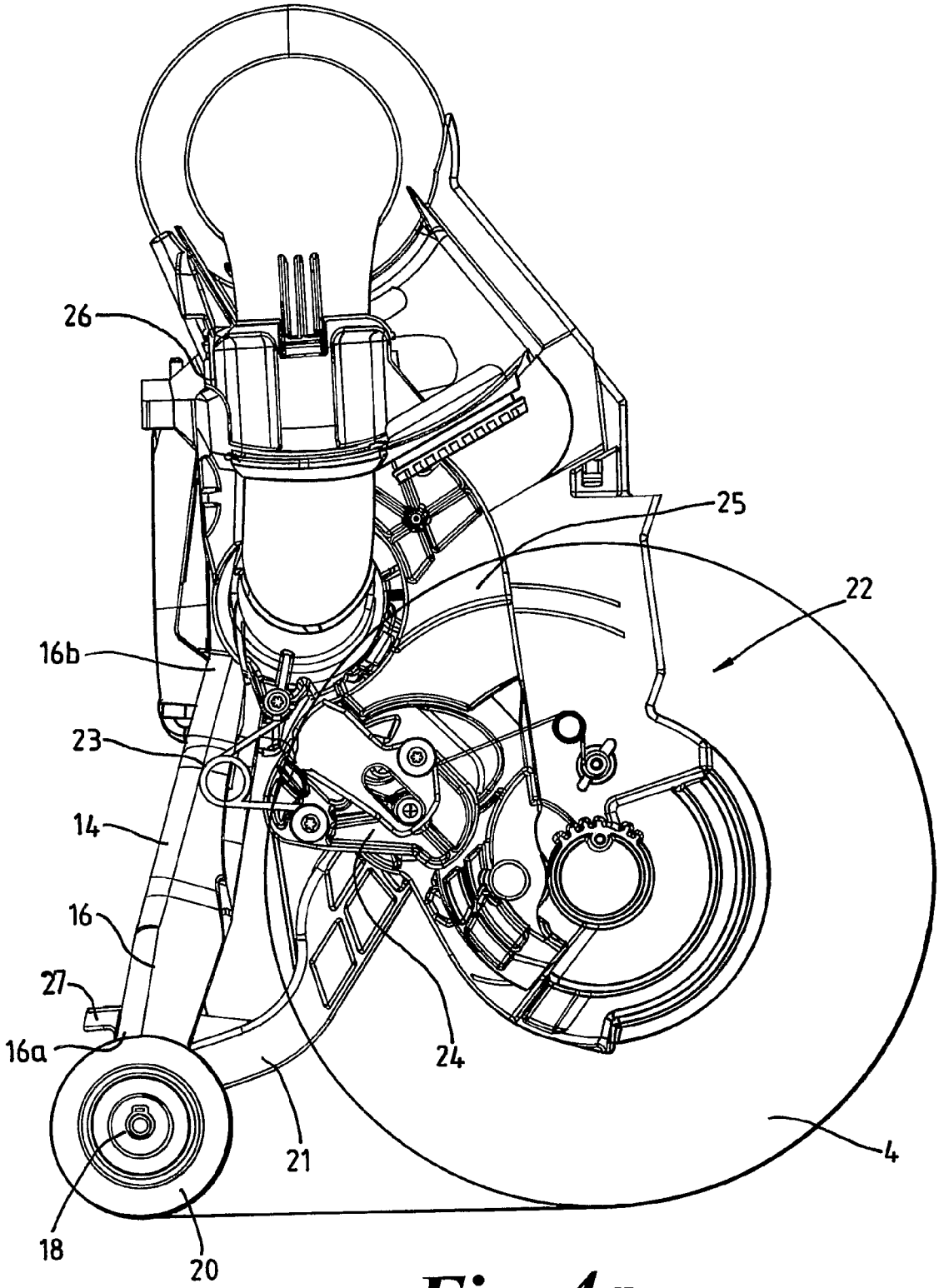
Figure 4B:
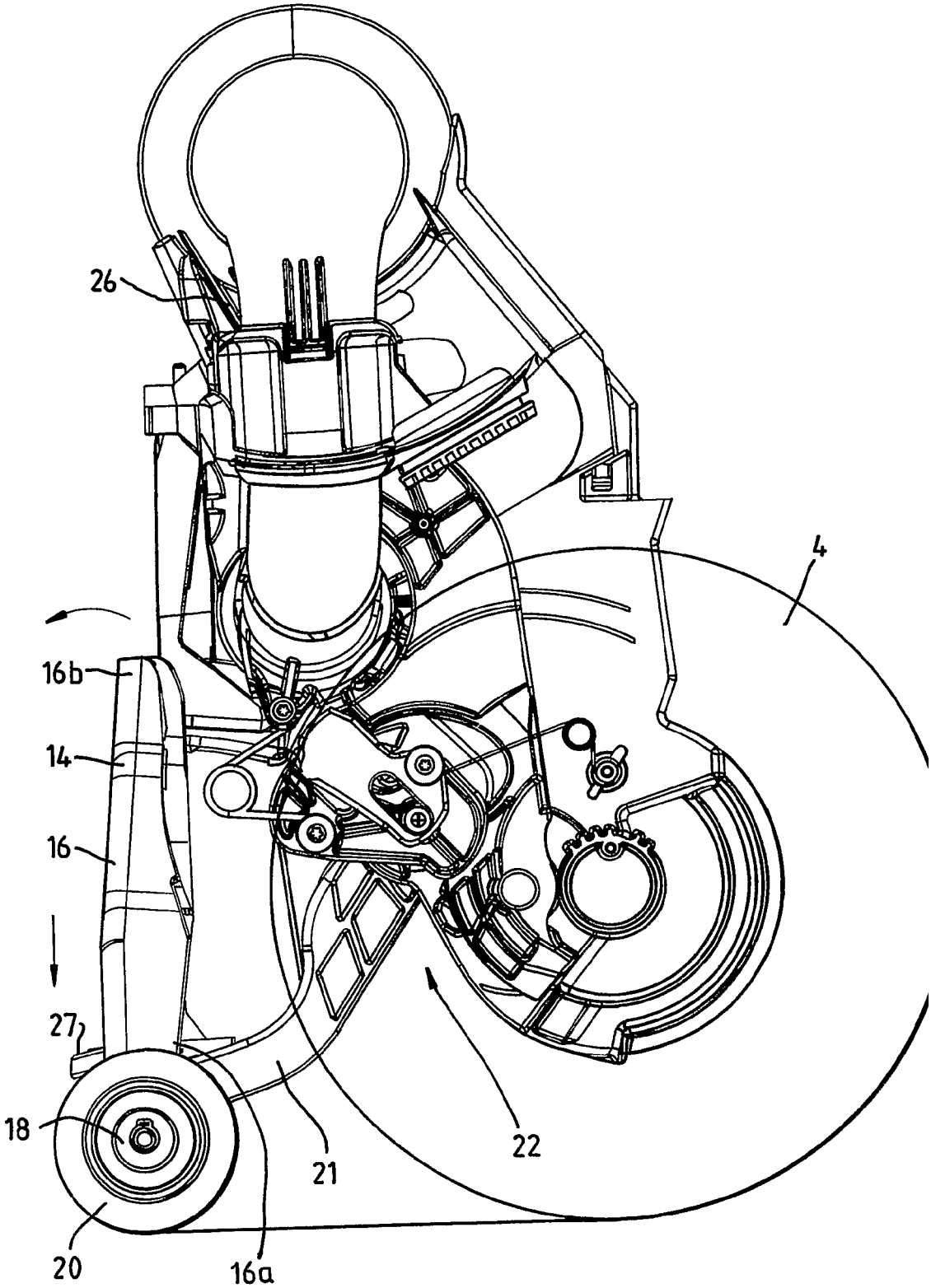
Figure 4C:
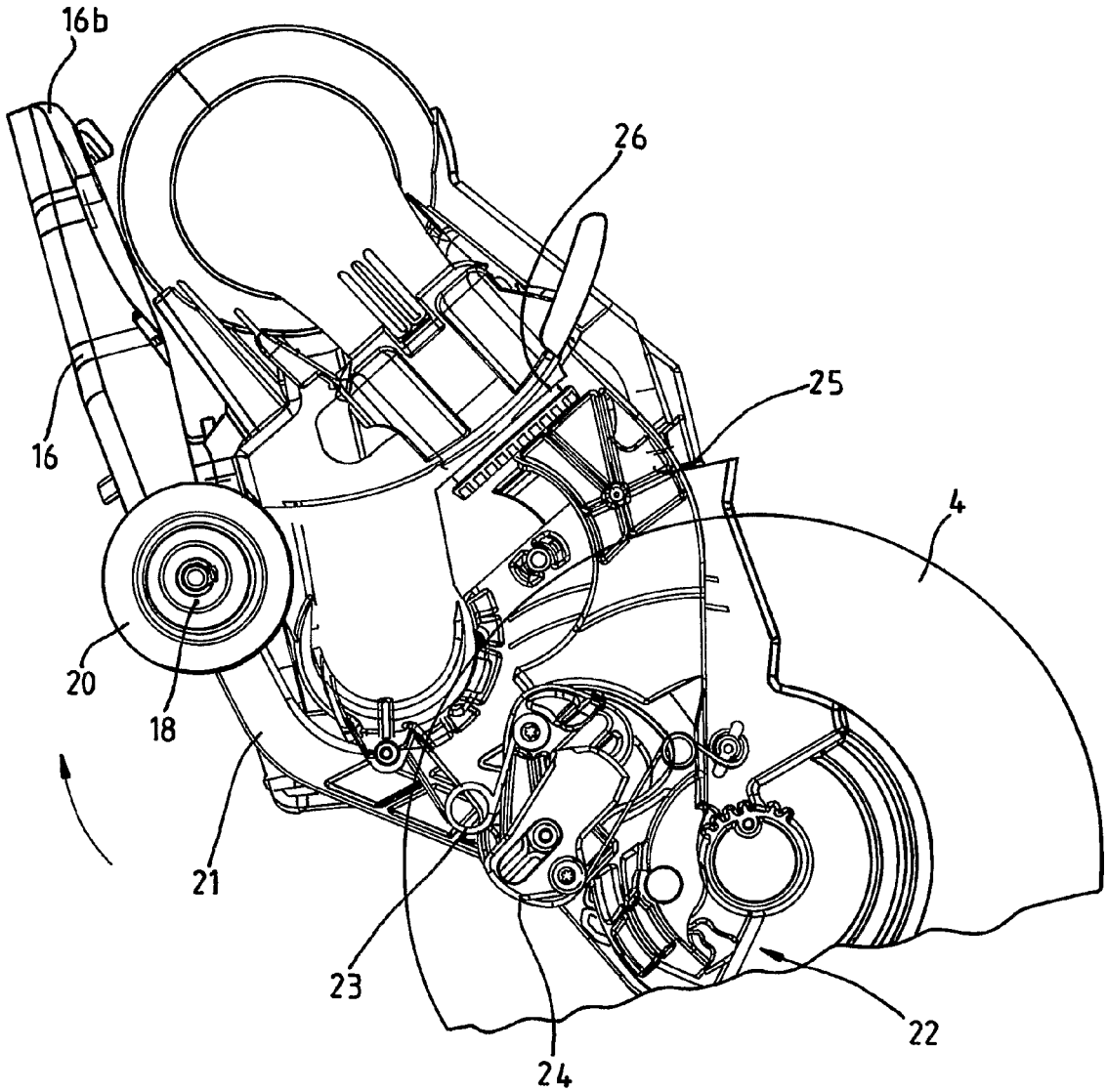
Figure 5A:
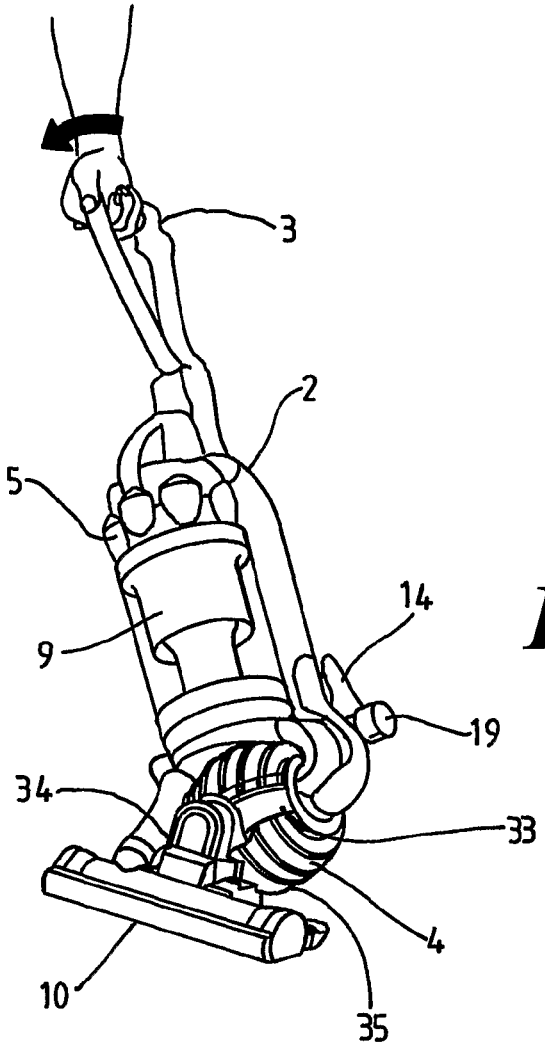
Figure 5B:
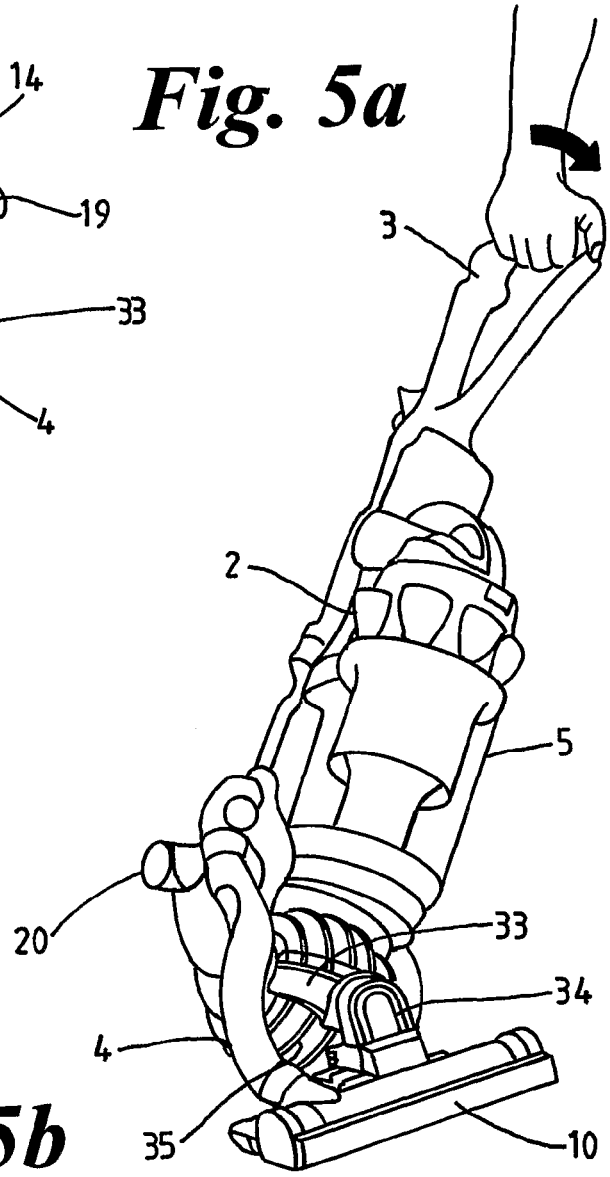
Figure 6:
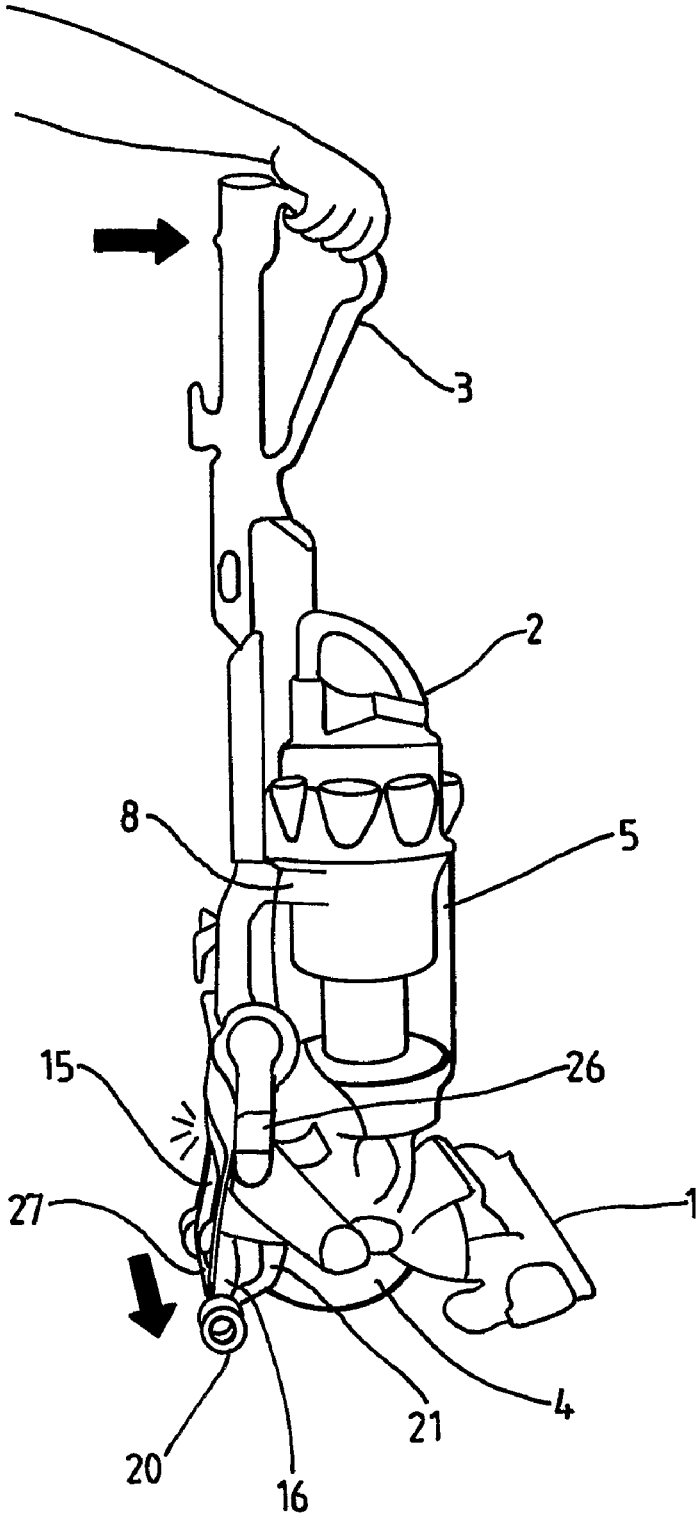

FIGS. 3*a* and 3*b* show the appliance of FIGS. 1 and 2 being put into a mode of cleaning by a user;

FIGS. 4*a*, 4*b* and 4*c* show, partly in section, details of the support assembly of the appliance of FIGS. 1 to 3;

FIGS. 5*a* and 5*b* show the appliance in different positions in use;

FIG. 6 shows the appliance being returned to a vertical position; and

Figure 7:
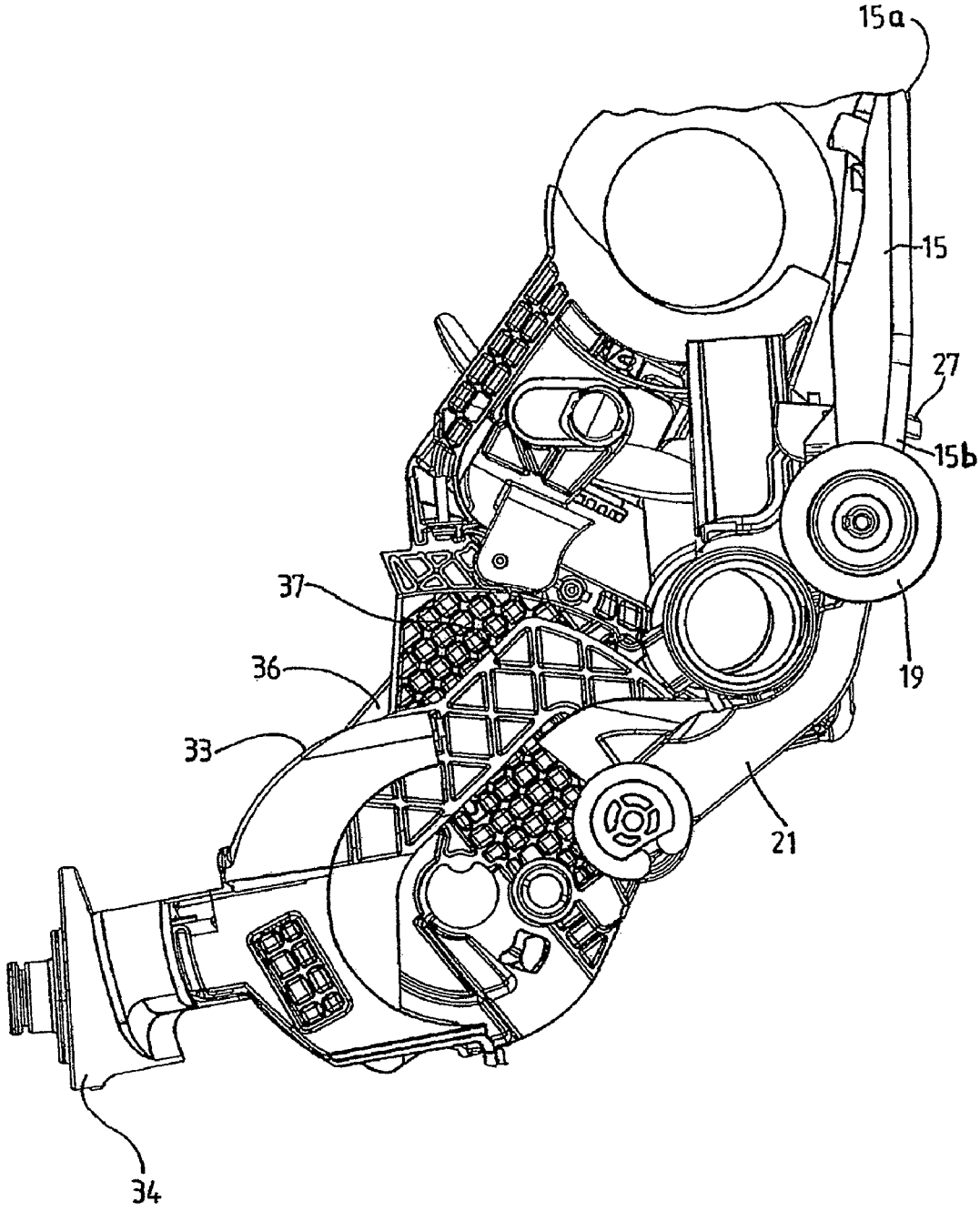

FIG. 7 shows, partly in section, details of part of the appliance during the operation shown in FIG. 6.

Like reference numerals refer to like parts throughout the specification.

DETAILED DESCRIPTION OF THE INVENTION

With reference to FIGS. 1 and 2, the surface treating appliance is shown in the form of a vacuum cleaner and is indicated generally by the reference numeral 1. The vacuum cleaner 1 comprises a main body 2, a user-operable handle 3 and a large roller 4 for rolling the cleaner along a floor surface. The roller 4 houses a motor and fan for generating a suction airflow (not visible in these drawings). The main body 2 houses separating apparatus 5 for separating dirt, dust and other debris from a dirty airflow drawn into the machine by the fan and motor.

In this embodiment, the separating apparatus 5 is cyclonic, in which the dirt and dust is spun from the airflow. The cyclonic separating apparatus 5 comprises two stages of cyclone separation arranged in series with one another. The first stage is a cylindrically-walled chamber 6 and the second stage comprises a set 7 of tapering, substantially frusto-conically shaped chambers arranged in parallel with one another. Airflow is directed tangentially into the upper part of a first cyclonic chamber 6 by a duct 8. Larger debris and particles are removed and collected in the first cyclonic chamber 6. The airflow then passes through a shroud 9 to the set 7 of smaller frusto-conically shaped cyclonic chambers. Finer dust is separated by these chambers and the separated dust is collected in a common collecting region. The second set 7 of separators can be upright, i.e. with their fluid inlets and outlets at the top and their dirt outlets at the bottom, or inverted, i.e. with their fluid inlets and outlets at the bottom and their dirt outlets at the top. The nature of the dust separating apparatus 5 is not material to the present invention.

The main body 2 also houses filters (not visible in these drawings) for trapping fine particles in the cleaned airflow. These filters remove any fine particles of dust which have not already been removed from the airflow by the separating apparatus. A first filter, called a pre-motor filter, is provided before the motor and fan. A second filter, called a post-motor filter, is provided after the motor and fan. Where the motor for driving the suction fan has carbon brushes, the post-motor filter also serves to trap any carbon particles emitted by the brushes. Clean air is then expelled to the atmosphere.

A cleaner head 10 is pivotably mounted to the lower end of the main body 2, and serves, in use, to treat the floor surface. In this embodiment, it comprises a housing with a chamber for supporting an agitator in the form of a brush bar 11. The lower, floor-facing side of the chamber has an air inlet slot 12 and the brush bar 11 is rotatably mounted in the chamber such that bristles on the brush bar can protrude through the inlet slot and can agitate the floor surface over which the cleaner head passes. The brush bar 11 is rotatably driven by a dedicated motor positioned on the cleaner head 10 (not shown). A system of gears (not shown) couples the motor to the brush bar 11.

The roller 4 permits the cleaner to be manoeuvred easily along a floor surface. However, the roller 4 may not provide sufficient support for the cleaner when the main body 2 is in the vertical, or substantially vertical position. To this end, a support assembly 13 is provided.

With reference to FIGS. 1, 2 and 4*a*, the support assembly 13 comprises a stand 14 having two legs 15, 16, with a reinforcing strut 17 extending between the legs. The end portions 15*a*, 16*a* of the legs 15, 16 nearest the floor surface terminate on a common horizontal axle 18 near the floor surface. Wheels 19, 20 are rotatably mounted to each end of the axle and are provided to aid a user in guiding the cleaner between rooms. The wheels 19, 20 are arranged outside the legs 15, 16 of the stand 14. This provides a wide wheel-base for extra stability. The other end portions 15*b*, 16*b* of the legs 15, 16 are arranged to engage in co-operating notches on the back of the main body 2 of the cleaner, so that the body bears against the top of the stand. The stand 14 is arranged to bear most of the load of the cleaner 1 when in this vertical position. In fact, the main body 2 is inclined backwards slightly, at an angle of around 3" to the vertical.

The support assembly 13 also comprises an inclined arm 21, which extends between the axle 18 of the stand 14 and an actuating mechanism 22 located adjacent the rotational axis of the roller 4. The arm 21 is pivotably mounted to the actuating mechanism 22 and is also rotatable about the axle 18 of the stand 14.

The main components of the actuating mechanism 22 are resilient means in the form of a spring 23, a slidable actuator member 24 and a changeover valve arm 25. These components are described in more detail below.

The handle 3 extends upwardly from the rear part of the main body 2. When the cleaner 1 is in the position shown in FIGS. 1 and 2, it can be used in a cylinder mode, in which case the handle 3 may be released and used as a hose and wand assembly. A changeover valve 26 on the main body 2 automatically connects the dust separating apparatus 5 to the wand and hose so that cleaner can be used in cylinder mode for above the floor cleaning. Air is drawn into the cleaner through the end of the wand which can be released from the cleaner for appropriate manipulation. The inlet 12 in the cleaner head 10 is automatically shut off.

When the cleaner 1 is to be used in conventional upright mode, the user reclines the main body 2. In order to do so, the support assembly 13 must be released from the supporting position shown in FIGS. 1, 2 and 4*a*. To this end, the foot pedal 27 is provided on the support assembly 13, adjacent the axle 18 for the stand 14. In order to bring the support assembly 13 out of the supporting position, the user depresses the pedal 27 with his foot against resilient means, as shown in FIG. 3*a*. This action causes the stand to pivot outwardly about the axle 18, away from the main body 2, as shown in FIG. 4*b*. The upper end portions 15*b*, 16*b* of the legs are brought out of engagement with the notches on the main body 2. When the stand 14 is released, the main body 2 no longer bears against the arms of the stand, but is instead supported by the user holding the handle 3. The cleaner 1 is now able to be reclined for cleaning of a floor surface in upright mode.

As the user employs the handle 3 to recline the main body 2 of the cleaner 1, the actuating mechanism 22 is arranged to put the support assembly 13 into a stored position, in which the support assembly lies substantially against the main body 2 of the cleaner 1. With reference to FIGS. 4*b* and 4*c*, as the main body 2 is reclined, the actuator member 24 rotates anti-clockwise with the main body. As it does so, it bears against a protrusion on the changeover valve arm 25, causing it to pivot in the opposite direction. When the main body 2 is inclined at approximately 40° to the vertical, the valve arm 25 is arranged to actuate the changeover valve 26 for cleaning in the upright mode. Resilient means in the form of a spring may be provided to bring the changeover valve positively into position.

The changeover valve automatically shuts off the air inlet at the distal end of the wand and connects the dust separating apparatus to the inlet in the cleaner head. A dirty-air inlet is located on the underside of the cleaner head. Dirty air is drawn into the dust separating apparatus via the dirty-air inlet by means of the motor-driven fan.

As the main body 2 is reclined further, the actuator member 24 pivots and brings the spring 23 into a position whereby it can act on the support assembly 13, urging the arm 21 of the support assembly upwardly. As the arm 21 pivots upwardly, it lifts the axle 18 and hence brings the stand 14 out of engagement with the floor. Lugs 29, 30 on the stand 14, extending upwardly from the reinforcing strut 17, are constrained to move in channels 31, 32 located on the rear of the main body 2. Therefore, the stand 14 slides upwardly against the main body 2. In the fully retracted position, as shown in FIGS. 3*b* and 4*c*, the support assembly 13 lies substantially against the main body 2 of the cleaner 1.

Another function of the actuating mechanism 22 is to release the cleaner head 10 for a cleaning operation. When the cleaner 1 is in the vertical position, with the support assembly 13 in the supporting position, the cleaner head 10 is latched with respect to the main body 2. This enables the user to tilt the cleaner 1 as a whole onto the wheels 19, 20 of the support assembly 13 so that the cleaner can be wheeled from location to location with out the cleaner head 10 drooping and obstructing manoeuvrability. The actuating mechanism 22 releases the cleaner head 10 from this position so that, as the main body 2 of the cleaner 1 is reclined, the head 10 remains in contact with the surface to be treated. This is the first step in the sequence of functions initiated by the actuating mechanism 22 and ensures that the cleaning head 10 is in the appropriate position for cleaning in the upright mode before the changeover valve 26 is actuated.

The cleaner head 10 is connected to the main body 2 of the vacuum cleaner 1 in such a manner that the cleaner head remains in contact with a floor surface as the main body is manoeuvred through a wide range of operating positions, e.g. when moved from side-to-side or when the main body is twisted about its longitudinal axis. A yoke 33 connects the main body 2 to the cleaner head 10. The yoke 33 is mounted to each end of the rotational axis of the roller 4. The yoke 33 can rotate independently of the main body 2. At the forward, central part of the yoke 33 there is a joint 34, which connects to the cleaner head 10.

The main body 2 is rotatably connected to the roller 4, which lies at the base of the main body. The roller 4 allows the apparatus to be easily pushed or pulled along a surface. The shape of the roller 4 and the connections between the main body 2 and the roller, and the roller and the cleaner head 10, allow the apparatus to be more easily manoeuvred than traditional vacuum cleaners.

The overall shape of the roller 4 resembles a barrel. Looking at the shape of the outer surface in the direction along the longitudinal axis, there is a generally flat central region and an arcuate region at each end where the diameter, or width, of the shell decreases. A flat central region aids a user in steering the machine along a straight line, since the machine will naturally run straight and is less likely to wobble during backwards movements. Ridges 35 are provided on the outer surface of the roller 4 to improve grip over surfaces.

The arrangement of the pivotal mounting of the yoke 33 and joint 34, allows the main body 2 together with the roller 4 to be rotated about its longitudinal axis, in the manner of a corkscrew, while the cleaner head 10 remains in contact with the floor surface. This arrangement also causes the cleaner head 10 to point in a new direction as the main body 2 is rotated about its longitudinal axis.

FIG. 3*b* shows the position for forward or backward movement in a straight line while FIGS. 5*a* and 5*b* show the vacuum cleaner in two different turning positions. FIG. 5*a* shows the vacuum cleaner turning towards the right. The main body 2 is rotated clockwise about its longitudinal axis. This raises the longitudinal axis of the roller 4 into a position which is inclined with respect to the floor and which is facing towards the right compared to the starting, straight running, position. The connection of the yoke 33 and joint 34 between the main body 2 and cleaner head 10 causes the cleaner head to point towards the right whilst remaining in contact with the floor. The extent to which the main body 2 is turned in the clockwise direction determines the extent to which the cleaner head 10 moves from its forward facing position towards the right. The smaller diameter part of the roller assembly not only allows the main body to roll onto one side, but tightens the turning circle of the vacuum cleaner.

FIG. 5*b* shows the vacuum cleaner turning towards the left. The main body 2 is rotated anti-clockwise about its longitudinal axis. This raises the longitudinal axis of the roller 4 into a position which is inclined with respect to the floor and which is facing towards the left compared to the starting, straight running, position. The connection between the main body 2 and cleaner head 10 causes the cleaner head to point towards the left, while still remaining in contact with the floor. The extent to which the main body 2 is turned in the anti-clockwise direction determines the extent to which the cleaner head 10 moves from its forward facing position towards the left.

The support assembly 13 remains neatly tucked up against the rear of the main body 2 during this range of motions performed by the cleaner 2. This permits the user easily to manoeuvre the cleaner, even when cleaning under furniture and other low obstructions.

When the user wishes to return the cleaner 1 to the vertical position, he pivotally moves the main body 2 back towards the vertical. As the main body 2 rotates, a region 36 of the yoke 33 that provides the connection between the main body 2 and the cleaner head 10 bears against the changeover valve arm 25 and urges it into the original position for above-floor cleaning via the hose and wand assembly. FIG. 7 shows the yoke 33 and parts of the actuating mechanism 22, but from the other side to that shown in FIGS. 4*a* to 4*c*, so that a limb 37 that protrudes from the yoke 33 is visible. As the main body 2 of the cleaner 1 is returned to the vertical position, the limb 37 on the yoke 33 bears against the arm 21 of the support assembly 13. The arm 21 of the support assembly 13 is urged downwardly, away from the main body 2. This causes the actuator member 24 to rotate clockwise (as viewed from the perspective of FIGS. 4*a* to 4*c*), and bring the spring 23 into a position where it can act on the support stand 14 and cause it to deploy with its wheels 19, 20 on the floor surface. This is shown in FIG. 6. It does this as the main body 2 approaches its original position of 3° from the vertical.

In this position, the resilient means associated with the pedal 27 assists in bringing the legs 15, 16 of the stand 14 back into engagement with the co-operating notches on the main body 2. The components may be arranged to produce a click or other sound, to indicate to the user that the appliance has been fully returned to the vertical position. Thus, the user releases the handle 3, leaving the min body 2 to be supported by the support assembly 13.

Of course, variations may be made without departing from the scope of the invention. For example, the actuating mechanism 22 may be coupled to the brush bar 11, so that the brush bar, or other agitator, is driveable only as the user reclines the cleaner for upright cleaning. This prevents the brush bar from being energised when the cleaner is in the vertical position, when it may be stationary for an extended period of time. Thus, excessive wear and tear on the floor surface is prevented. The actuating mechanism may further be arranged to cause the agitator to be driven automatically as the main body is reclined, without the need for selective energisation by the user. Similarly, the mechanism may be arranged automatically to interrupt driving of the agitator when the cleaner is returned to the vertical position.

The provision of a depressible pedal makes the cleaner user-friendly when converting from cylinder-type cleaning to upright cleaning. However, it is possible that some users may not appreciate the presence of the pedal and may be more familiar with cleaners in which this conversion is effected by pushing down on the cleaner head itself as the body is reclined. Therefore, the actuating mechanism may be arranged so as to release the cleaner head from its latched position in the event that a downward force over a predetermined limit is applied to the cleaner head. This allows the head to drop down onto the floor surface for upright-type cleaning. When the main body is returned to the vertical position, the actuating mechanism re-sets itself, so that the user can subsequently recline the main body in the correct manner by means of the pedal. This feature prevents the cleaner head from being damaged if the user tries to deploy the cleaner head in the wrong manner.

It is also possible that a user may misuse the appliance, or else be unaware of the operation of the actuating mechanism, and may try to move the components manually. Therefore, the actuating mechanism is arranged to be completely self-resetting when the appliance is returned to the vertical position. This feature ensures that the sequence of operations activated by the mechanism does not get out of synchronisation if the appliance is used incorrectly.

While the illustrated embodiment shows a vacuum cleaner in which ducts carry airflow, it will be appreciated that the invention can be applied to cleaners which carry other fluids, such as water and detergents.

Separation of dust from the airflow could equally be carried out using other means such as a conventional bag-type filter, a porous box filter, an electrostatic separator or some other form of separating apparatus. For embodiments of the apparatus which are not vacuum cleaners, the main body can house equipment which is appropriate to the task performed by the machine. For example, for a floor polishing machine the main body can house a tank for storing liquid wax The brush bar can be driven in other ways, such as by a turbine which is driven by incoming or exhaust airflow, or by a coupling to the motor which is also used to drive the suction fan. The coupling between the motor and brush bar can alternatively be via a geared coupling. In alternative embodiments the brush bar can be removed entirely so that the machine relies entirely on suction or by some other form of agitation of the surface. For other types of surface treating machines, the cleaner head can include appropriate means for treating the floor surface, such as a polishing pad, a liquid or wax dispensing nozzle etc. The lower face of the cleaner head can include small rollers to ease movement across a surface.

The invention claimed is:

1. A surface-treating appliance, comprising:

a main body moveable between a substantially vertical position and a reclined position, a surface-treating head and a support assembly moveable between a supporting position, in which the support assembly supports the main body, and a stored position, in which the support assembly lies substantially against the main body, and an actuating mechanism arranged to bring the support assembly from the supporting position into the stored position as the main body is reclined by a user, the actuating mechanism comprising a resilient member arranged to assist in moving the support assembly to the stored position.

2. An appliance as claimed in claim 1, further comprising a user-operable pedal arranged so that depressing the pedal brings the support assembly out of the supporting position.

3. An appliance as claimed in claim 1 or 2, in which the actuating mechanism is arranged to bring the support assembly into the supporting position as the main body is returned to the vertical position by the user.

4. An appliance as claimed in claim 1 or 2, further comprising a changeover mechanism arranged to allow fluid flow from the surface-treating head or from a hose located on the main body, the actuating mechanism being arranged to cause the changeover mechanism to allow fluid flow from the surface treating head when the main body is in the reclined position.

5. An appliance as claimed in claim 4, the actuating mechanism being further arranged to cause the changeover mechanism to allow fluid flow from the hose when the main body is in the vertical position.

6. An appliance as claimed in claim 1 or 2, further comprising a roller which is rotatably mounted to the main body for allowing the main body to be moved along a surface.

7. An appliance as claimed in claim 6, wherein the roller houses a component of the appliance.

8. An appliance as claimed in claim 7, wherein the component comprises a motor and fan arrangement arranged, in use, to generate a fluid flow.

9. An appliance as claimed in claim 1 or 2, in which the support assembly includes at least one wheel for allowing the appliance to be rolled along a surface.

10. An appliance as claimed in claim 9, in which the wheel has a fixed axis.

11. An appliance as claimed in claim 1 or 2, in which, in the supporting position, the stand is arranged to engage in a co-operating notch on the main body.

12. An appliance as claimed in claim 1, in which the resilient member is arranged to assist in returning the support assembly to the supporting position.

13. An appliance as claimed in claim 1 or 2, in which the support assembly is located on a rear portion of the appliance.

14. An appliance as claimed in claim 1 or 2, further comprising a channel on the main body arranged to constrain the support assembly to slidably move into the stored position.

15. An appliance as claimed in claim 1 or 2, in which the surface-treating head is arranged in a fixed position with respect to the main body when the support assembly is in the supporting position.

16. An appliance as claimed in claim 15, in which the surface-treating head is arranged to bear against a floor surface when the support assembly is moved out of the supporting position.

17. An appliance as claimed in claim 15, in which the surface-treating head is arranged so that the user can cause it to engage with a floor surface by applying downwardly-directed force above a predetermined value to the head.

18. An appliance as claimed in claim 1 or 2, further comprising a linkage between the main body and the surface-treating head arranged such that rotating the main body about its longitudinal axis causes the head to point in a new direction.

19. An appliance as claimed in claim 18, in which the linkage is arranged to assist in moving the support assembly into the support position.

20. An appliance as claimed in claim 1 or 2, in which the surface-treating head has a driveable agitator.

21. An appliance as claimed in claim 20, in which the agitator is driveable when the support assembly is brought out of the supporting position.

22. An appliance as claimed in claim 20, in which the agitator is automatically driven when the support assembly is brought out of the supporting position.

23. An appliance as claimed in claim 20, in which the agitator is prevented from being driven when the support assembly is in the supporting position.

24. An appliance as claimed in claim 20, in which the agitator is a brush bar.

25. A vacuum cleaner comprising the appliance as claimed in claim 1 or 2.

26. A vacuum cleaner as claimed in claim 25, further comprising a cyclonic dirt and dust separating apparatus.

* * * * *